US007625105B1

(12) United States Patent
Johnson

(10) Patent No.: US 7,625,105 B1
(45) Date of Patent: Dec. 1, 2009

(54) RELAMPING CARTRIDGE ASSEMBLY

(75) Inventor: Terry D. Johnson, Baldwyn, MS (US)

(73) Assignee: Genlyte Thomas Group, LLC, Burlington, MA (US)

( * ) Notice: Subject to any disclaimer, the term of this patent is extended or adjusted under 35 U.S.C. 154(b) by 252 days.

(21) Appl. No.: 11/857,077

(22) Filed: Sep. 18, 2007

(51) Int. Cl.
*F21V 17/06* (2006.01)

(52) U.S. Cl. ..... 362/364; 362/147; 439/346

(58) Field of Classification Search ..... 362/145–147, 362/364, 640, 647, 652, 655, 656; 439/346, 439/352, 360, 366
See application file for complete search history.

(56) References Cited

U.S. PATENT DOCUMENTS

| | | | |
|---|---|---|---|
| 394,680 | A | 10/1888 | Dawes |
| 393,126 | A | 11/1888 | Smart |
| 684,264 | A | 10/1901 | Kemmerer |
| 866,473 | A | 9/1907 | Keefe et al. |
| 1,127,527 | A | 2/1915 | Schoen |
| 1,137,906 | A | 5/1915 | Rosenberg |
| 1,501,524 | A | 7/1924 | Cousins |
| 1,631,488 | A | 6/1927 | Jones |
| 1,662,568 | A | 3/1928 | Foell |
| 1,704,626 | A | 3/1929 | Nero |
| 2,518,936 | A | 8/1950 | Roberts |
| 2,554,258 | A | 5/1951 | Lundquist |
| 2,639,368 | A | 5/1953 | Pryne |
| 2,647,202 | A | 7/1953 | Elmer |
| 2,716,185 | A | 8/1955 | Burliuk et al. |
| 2,739,226 | A | 3/1956 | Rex |
| 2,753,445 | A | 7/1956 | Thomas et al. |
| 2,757,818 | A | 8/1956 | Chanberlain |
| 2,762,598 | A | 9/1956 | Runge |
| 2,802,933 | A | 8/1957 | Broadwin |
| 2,842,281 | A | 7/1958 | Chisholm |
| 2,922,030 | A | 1/1960 | Bobrick |
| 2,937,841 | A | 5/1960 | Bodian |
| 2,965,348 | A | 12/1960 | Gerstel et al. |
| 3,057,993 | A | 10/1962 | Gellert |
| 3,082,023 | A | 3/1963 | Rudolph et al. |
| 3,168,252 | A | 2/1965 | Cagernoch |
| 3,182,187 | A | 5/1965 | Gellert |
| 3,313,931 | A | 4/1967 | Klugman |
| 3,381,123 | A | 4/1968 | Docimo |
| 3,420,995 | A | 1/1969 | Dunckel |
| 3,512,743 | A | 5/1970 | Lipscomb |
| 3,518,420 | A | 6/1970 | Kripp |
| 3,590,241 | A | 6/1971 | Docimo et al. |
| 3,609,346 | A | 9/1971 | Lund et al. |
| 3,683,173 | A | 8/1972 | Guth, Jr. |
| 3,697,742 | A | 10/1972 | Bobrick |
| 3,700,885 | A | 10/1972 | Bobrick |
| 3,749,873 | A | 7/1973 | Harper et al. |
| 3,778,609 | A | 12/1973 | Ligerman |
| 3,872,296 | A | 3/1975 | Cohen et al. |
| 4,039,822 | A | 8/1977 | Chan et al. |
| 4,086,480 | A | 4/1978 | Lahm |

(Continued)

*Primary Examiner*—Hargobind S Sawhney
(74) *Attorney, Agent, or Firm*—Middleton & Reutlinger; John F. Salazar

(57) ABSTRACT

A re-lamping cartridge assembly for a recessed lighting fixture comprises a cartridge having a sidewall defining an upper aperture and a lower aperture, a lamp positioned within the upper aperture and adjacent the lower aperture; and, a spring positioned within the cartridge to engage the sidewall and capture the lamp within the cartridge.

20 Claims, 10 Drawing Sheets

U.S. PATENT DOCUMENTS 4,142,227 A 2/1979 Aikens
4,232,361 A 11/1980 Kelsall
4,250,540 A 2/1981 Kristofek
4,274,615 A 6/1981 Chan et al.
4,293,895 A 10/1981 Kristofek
4,318,161 A 3/1982 Shanks
4,318,162 A 3/1982 Sip
4,336,575 A 6/1982 Gilman
4,382,274 A 5/1983 De Backer et al.
4,408,262 A 10/1983 Kusmer
4,414,617 A 11/1983 Galindo
4,431,151 A 2/1984 Schonasky
4,437,142 A 3/1984 Donato et al.
4,459,648 A 7/1984 Ullman
4,471,416 A 9/1984 Druffel
4,473,873 A 9/1984 Quiogue
4,475,147 A 10/1984 Kristofek
4,510,559 A 4/1985 Kristofek
4,605,816 A 8/1986 Jorgensen et al.
4,623,956 A 11/1986 Conti
4,646,212 A 2/1987 Florence
4,704,664 A 11/1987 McNair
4,729,080 A 3/1988 Fremont et al.
4,733,339 A 3/1988 Kelsall
4,745,533 A 5/1988 Smerz
4,751,624 A 6/1988 Russo et al.
4,751,627 A 6/1988 Usher
4,754,377 A 6/1988 Wenman
4,829,410 A 5/1989 Patel
4,887,196 A 12/1989 Brown et al.
5,032,966 A * 7/1991 Maurer ..... 362/429
5,045,985 A 9/1991 Russo et al.
5,068,772 A 11/1991 Shapiro et al.
5,122,944 A 6/1992 Webb
5,124,901 A 6/1992 Sojka et al.
5,130,914 A 7/1992 Bengochea
5,222,800 A 6/1993 Chan et al.
5,291,381 A 3/1994 Price
5,314,148 A 5/1994 Jones
5,317,493 A 5/1994 Muller et al.
5,373,431 A 12/1994 Hayman et al.
5,377,088 A 12/1994 Lecluze
5,452,193 A 9/1995 Hinnefeld et al.
5,457,617 A 10/1995 Chan et al.
5,538,214 A 7/1996 Sinila
5,556,188 A 9/1996 Poppenheimer
5,562,343 A 10/1996 Chan et al.
5,564,815 A 10/1996 Litman et al.
5,567,041 A 10/1996 Slocum
5,609,414 A 3/1997 Caluori
5,630,663 A 5/1997 Ling et al.
5,669,324 A 9/1997 Muir, III
5,672,004 A 9/1997 Schmidt, Jr.
5,738,436 A 4/1998 Cummings et al.
5,758,959 A 6/1998 Sieczkowski
5,823,664 A 10/1998 Demshki, Jr. et al.
5,826,970 A 10/1998 Keller et al.
5,857,766 A 1/1999 Sieczkowski
5,941,625 A 8/1999 Morand
5,951,151 A 9/1999 Doubeck et al.
6,079,852 A 6/2000 Kamaya et al.
6,113,245 A 9/2000 Reinert, Sr.
6,132,245 A 10/2000 Wertz et al.
6,142,439 A 11/2000 Aramaki
6,145,798 A 11/2000 Janisse et al.
6,220,728 B1 4/2001 Andrus et al.
6,234,644 B1 5/2001 Kotovsky et al.
6,270,238 B1 8/2001 Mendelsohn et al.
6,340,310 B2 * 1/2002 Henrici et al. ..... 439/346
6,343,873 B1 2/2002 Eberhard et al.
6,364,510 B1 4/2002 Bernhart et al.
6,375,338 B1 4/2002 Cummings et al.
6,431,723 B1 8/2002 Schubert et al.
6,457,848 B1 * 10/2002 Wolf et al. ..... 362/364
6,505,960 B2 1/2003 Schubert et al.
6,582,253 B1 * 6/2003 Lau ..... 439/646
7,118,254 B2 10/2006 Czech
7,175,300 B1 * 2/2007 Medeiros ..... 362/223
7,234,674 B2 6/2007 Rippel et al.

* cited by examiner

RELAMPING CARTRIDGE ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention pertains to light fixtures. Particularly, the present invention pertains to recessed light fixtures and a re-lamping cartridge assembly.

2. Description of the Related Art

Recessed lighting fixtures have become popular for both residential and commercial uses. Some recessed fixtures are adjustable to aim the output light by rotating the fixture about a vertical axis, for example, extending through the lamp as well as pivoting the lamp about an axis perpendicular to the vertical axis. Thus, the lamp may be adjustable about two axes to aim the light output from the recessed luminaire.

One problem with present recessed lighting fixtures is the ease with which lamps may be replaced. Many fixtures, such as low voltage fixtures, utilize small lamps which are difficult to handle. Further, in order to provide improved re-lamping capability, it may be desirable to utilize lamp designs which allow for tool-less re-lamping of a recessed fixture.

SUMMARY OF THE INVENTION

A re-lamping cartridge assembly for a recessed lighting fixture comprises a cartridge having a sidewall defining an upper aperture and a lower aperture, a lamp positioned within the upper aperture and adjacent the lower aperture; and, a spring positioned within the cartridge to engage the sidewall and capture the lamp within the cartridge. The cartridge further comprises a retaining feature. The cartridge assembly further comprises a spring seat. The cartridge further comprises a lip along an interior of the cartridge, the lamp seated against the lip. The spring engages the lamp and captures the lamp between the lip and the spring. The spring has a first finger extending above an upper peripheral edge of the cartridge. The cartridge assembly further comprises a second finger opposite the first finger, the second finger extends above the upper peripheral edge of the cartridge. The cartridge assembly further comprises a support collar adjustably retaining the cartridge in a recessed fixture housing.

A re-lamping cartridge assembly comprises a cartridge having a light output aperture and an upper opening, a lamp positioned against the light output opening and, a spring having a lamp aperture, the spring positioned over the lamp wherein the lamp extends through the lamp aperture, the spring capturing the lamp against the cartridge. The cartridge assembly further comprising a lip extending radially inward from a spring seat. The cartridge assembly further comprises the lamp seated against the lip. The spring is seated against the spring seat. The cartridge assembly further comprises a retaining feature on an exterior of the cartridge. The retaining feature comprises a groove extending along the outer circumference of the cartridge. The cartridge assembly further comprises a cartridge support collar retaining the cartridge in position within a light fixture. The cartridge assembly further comprising at least one retaining spring extending from the cartridge support collar. The cartridge assembly further comprises a knee extending from the at least one retaining spring for engaging the cartridge.

The cartridge assembly for a light fixture comprises a cartridge having a sidewall defining an upper opening and a lower opening, a lamp disposed within the sidewall and adjacent the lower opening; a spring disposed within the cartridge and engaging the lamp and the sidewall, a cartridge support collar engaging the cartridge sidewall. The cartridge support collar having at least one retaining mechanism, the at least one retaining mechanism further comprising a knee and the cartridge engaging the knee.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
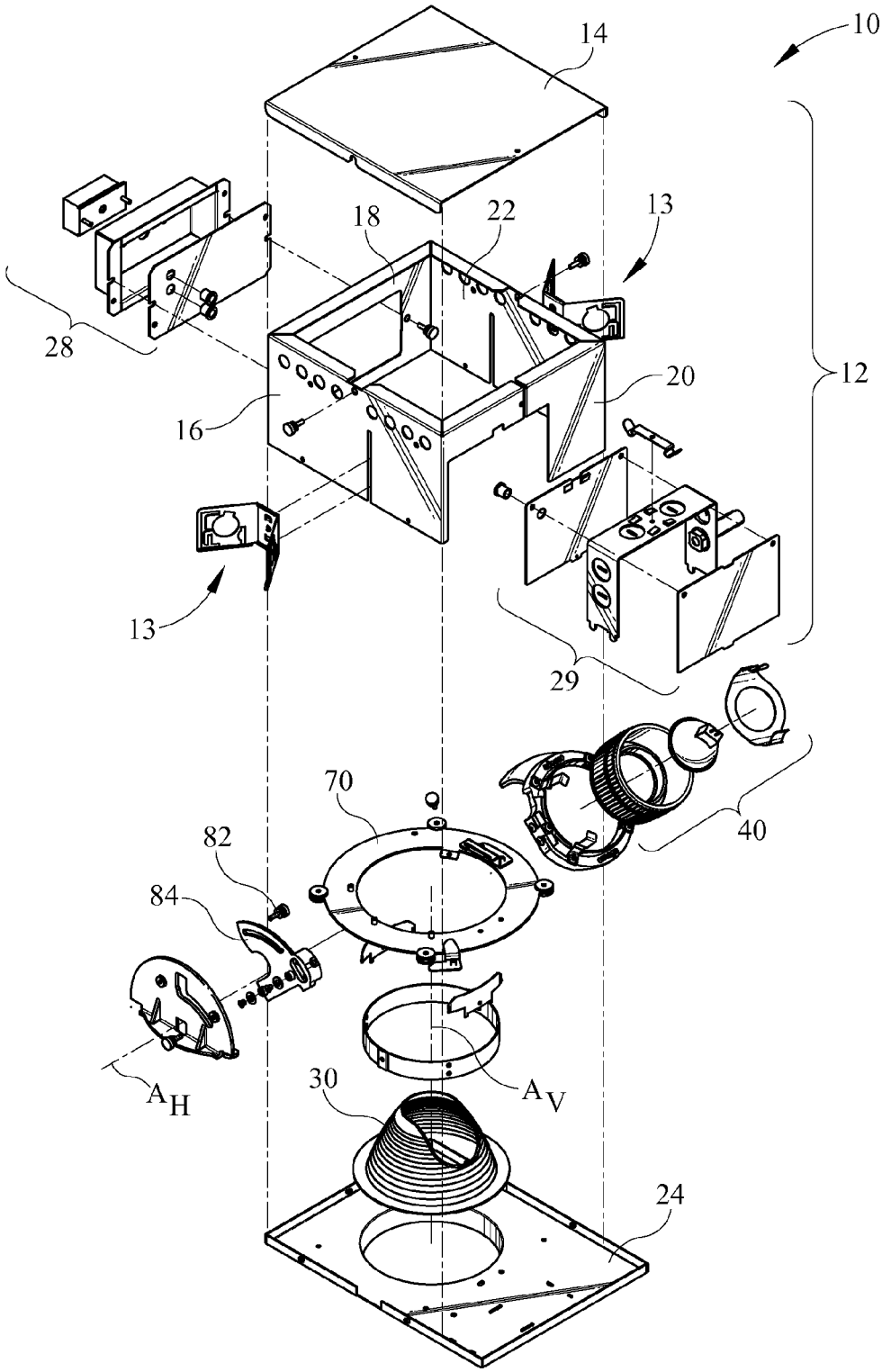
FIG. 1 is an exploded view of an exemplary recessed lighting fixture.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-10 various aspects of a cartridge re-lamping assembly. The cartridge re-lamping assembly allows easy changing of a recessed lamp by removal of a cartridge wherein a lamp is located so that the lamp and cartridge are easily handled. Once the cartridge is removed, the lamp may be changed and the cartridge repositioned in the recessed light fixture.

Figure 2:
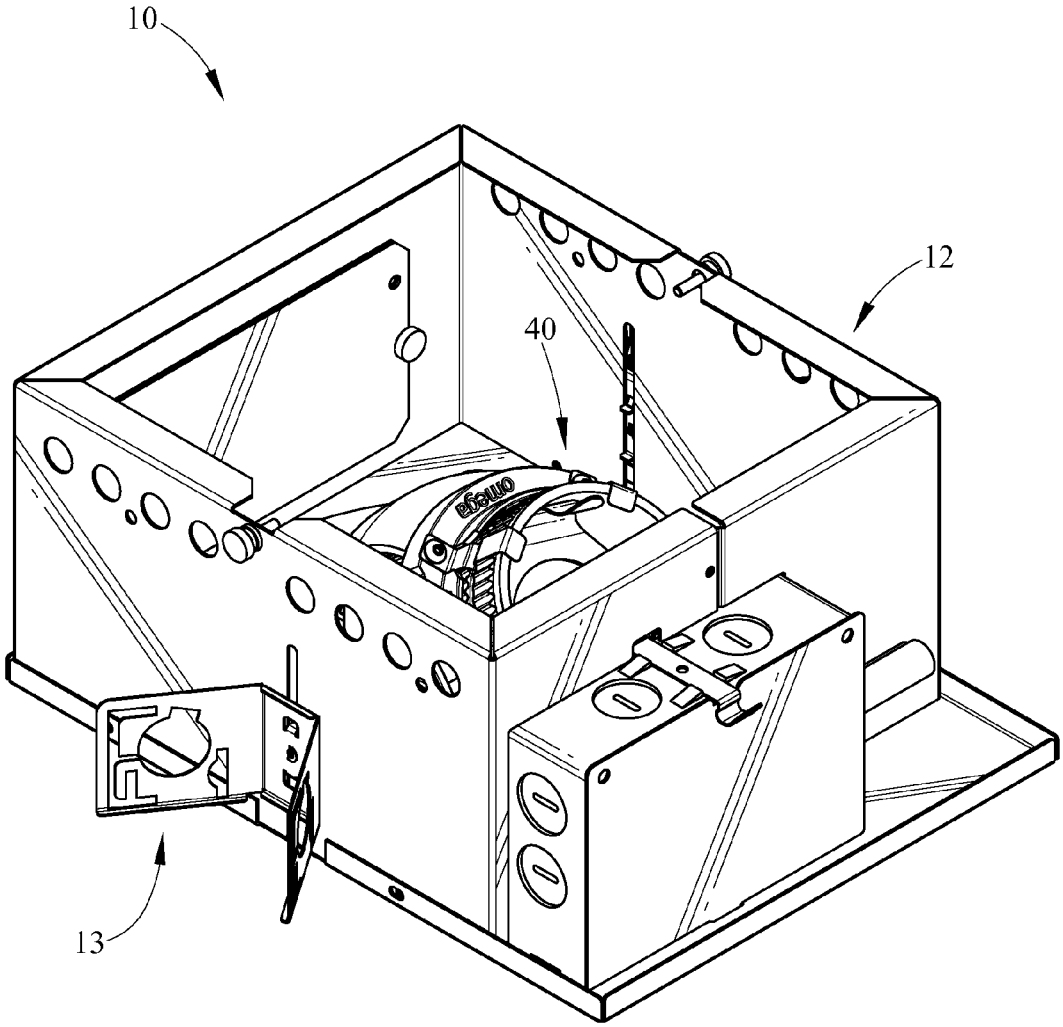
FIG. 2 is a perspective view of the recessed fixture of FIG. 1 with the housing top removed.
Figure 3:
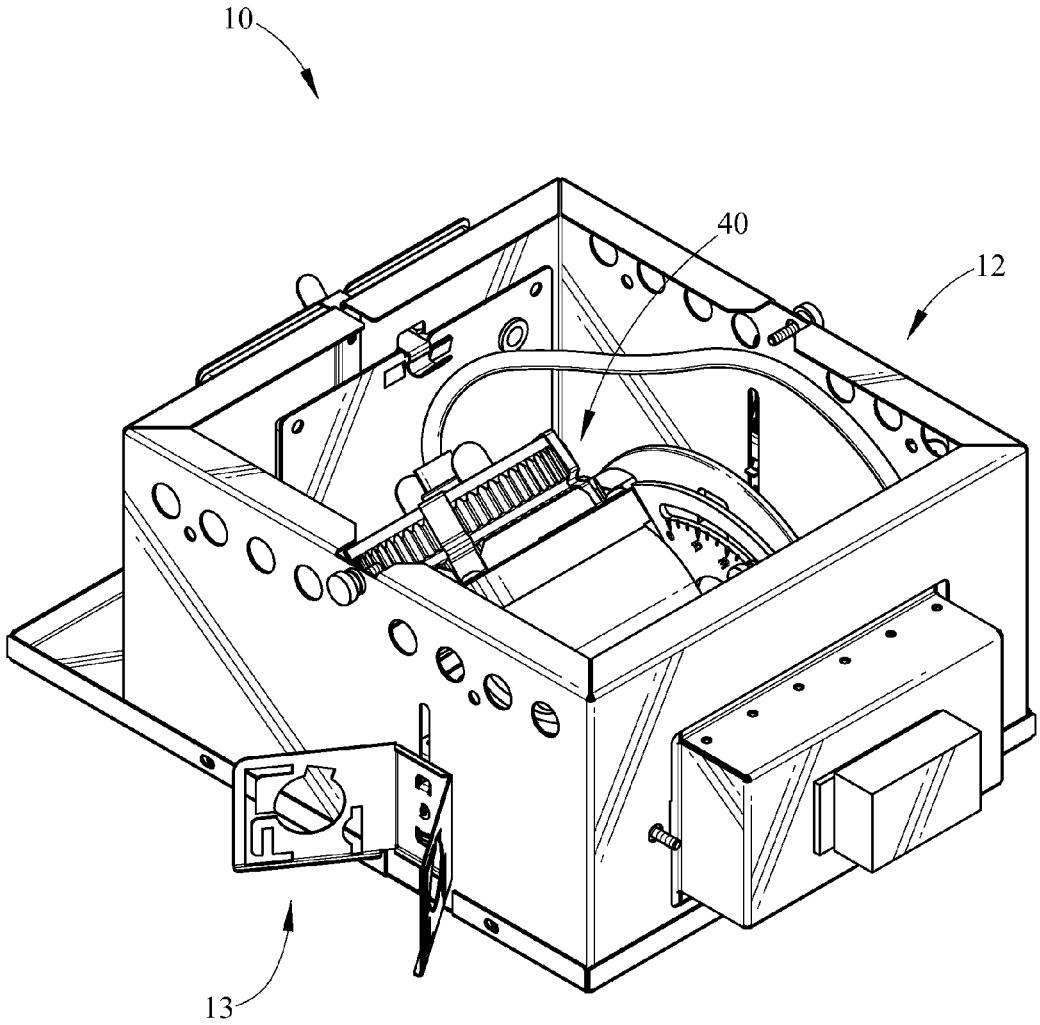
FIG. 3 is a perspective view of the recessed fixture of FIG. 2 rotated to depict the opposite interior side of the fixture.

As shown in FIGS. 1-3, a recessed lighting fixture 10 is depicted in an exploded view as well as first and second perspective views, respectively. Referring first to FIG. 1, the fixture 10 comprises a housing 12 having a top 14, a plurality of sidewalls 16, 18, 20, 22 and a pan 24 defining the housing box 12 within which the fixture mechanisms may be positioned. At a lower portion of the housing 12, the pan 24 generally closes the housing 12.

At side 18 of the housing is a ballast assembly 28. An aperture is positioned within sidewall 18 for properly locating the ballast assembly 28. Likewise, along the opposite side 20 is a junction box assembly 29 for making wiring connections between a power source and the fixture 10.

In the exploded view of FIG. 1, above the housing pan 24 is a reflector or trim 30, which redirects light from a lamp 50 (FIG. 6) which is part of a cartridge assembly 40. The cartridge assembly 40 is rotatably connected to the housing pan 24 by a rotation plate 70 for rotation of the cartridge assembly 40 about a vertical axis $A_V$ extending vertically through the rotation plate 70. The cartridge assembly 40 is also adjustable about an axis which is substantially horizontal $A_H$ and perpendicular to the vertical axis $A_V$. This pivotal adjustment mechanism is also depicted in FIG. 1 comprising plates 80 and 84. The housing 12 may further comprise hanger bar brackets 13, which receive hanger bars (not shown) for mounting to ceiling support members.

Referring now to FIG. 2, a perspective view of the fixture 10 is depicted. The top 14 is removed depicting the interior of the housing 12. The cartridge assembly 40 is tilted at an angle in order to provide, for example, a wall wash light. The cartridge assembly 40 may be adjusted to provide downlight, wall-wash or rotate to illuminate an area.

Referring now to FIG. 3, the housing 12 has been rotated about a vertical axis to depict the opposite side of the interior portion of the housing as well as further depict the cartridge assembly 40 at the tilted angle shown in FIG. 2. An electrical cable 19 is depicted extending from the junction box to a connection at an upper end of the cartridge assembly 40 for powering the lamp 50. The connector will vary depending on the lamp utilized, as will be understood by one skilled in the art. Therefore one skilled in the art should realize that the cartridge assembly 40 may receive a multitude of lamp sizes as long as the internal components of the cartridge 43 are appropriately sized for the lamp size selected.

Figure 4:
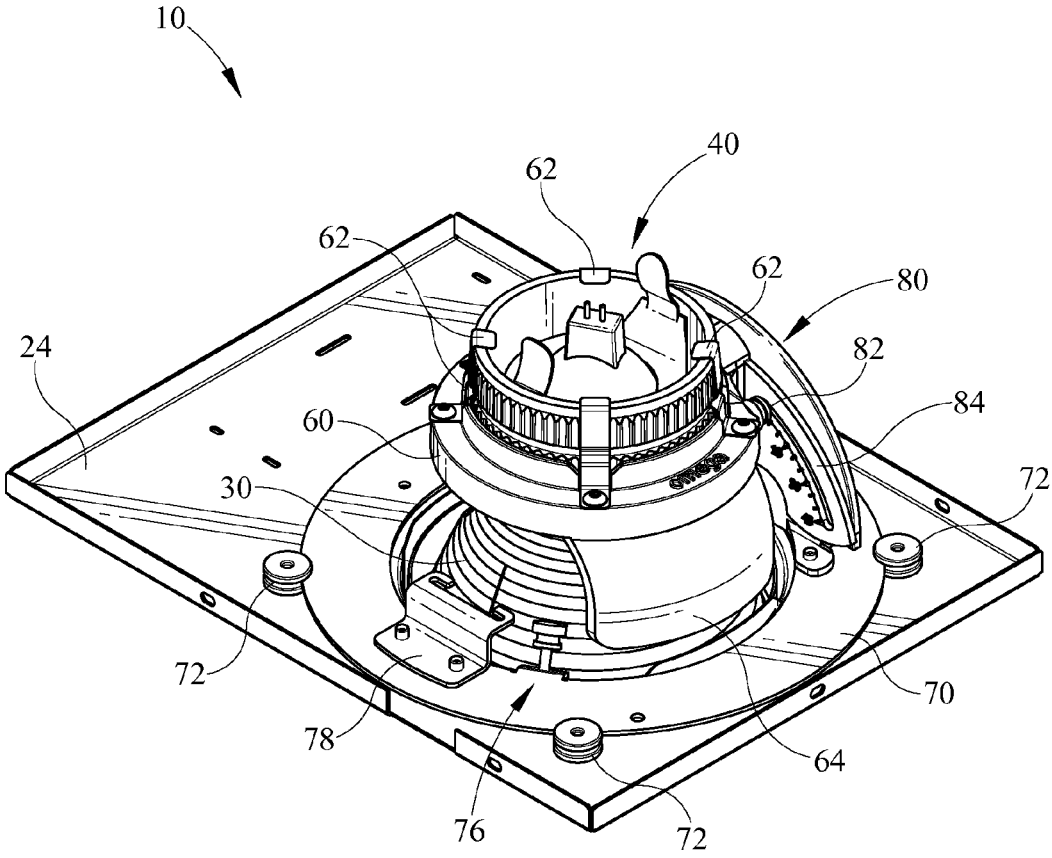
FIG. 4 is a perspective view of a recessed lighting fixture with all the housing removed except for the housing pan.

Referring now to FIG. 4, the recessed fixture 10 is depicted with the housing 12 generally removed, except for the housing pan 24, in order to depict the interior portions of the fixture 10. The recessed fixture assembly 10 further comprises a rotating plate 70 which moves within a plurality of guides 72. Each guide 72 comprises at least one track for receiving the plate 70. The plate 70 is generally circular so that a peripheral edge thereof is disposed within the track or channel of each guide 72 allowing rotation of the plate 70 relative to the guide 72 and the housing pan 24. The plate 70 may also comprise a brake assembly 76. In the exemplary embodiment, the brake 76 inhibits rotation of the plate 70 relative to the pan 24. A reflector trim 30 is connected to the rotating plate 70 in order to allow rotation of the reflector 30 and upper portions of the fixture assembly 10 when the plate 70 rotates about a vertical axis.

A pivot plate 80 extends upwardly from the rotating plate 70 so that the pivot plate 80 rotates with the turning of the rotating plate 70. A pin 82 extends from or is otherwise connected to the pivot plate 80 and a track plate 84 is positioned over the pin 82 to pivot about a horizontal axis relative to the pin 82 and the plate 80 and relative to the rotating plate 70. Thus, the recessed fixture assembly 10 allows for rotation about a vertical axis $A_V$ via the rotating plate 70 and about a horizontal axis $A_H$ via the sliding motion of the track plate 84 relative to the pin 82 and the pivot plate 80. The track plate 84 or the pivot plate 80 may have graduated measuring numerals to indicate the angle of rotation of the track plate 84 and therefore the cartridge assembly 40.

Connected to the track plate 84 is a cartridge support collar 60 which is generally cylindrical in shape with an open or hollow middle portion. The collar 60 moves with rotation of plate 70 and pivoting of the track plate 80 about two axes. The collar 60 is disposed over the reflector trim 30 and therefore moves with rotation of the plate 70 and the track plate 84. The collar 60 further comprises a plurality of retaining mechanisms 62 extending from an upper portion of the collar 60. The retaining mechanisms 62 are depicted as spring or biasing structures having an upper leg engaging an upper portion of a re-lamping cartridge assembly 40 and having a knee 63 (FIG. 8) which engages a groove 49 (FIG. 5) in the re-lamping cartridge assembly 40. Thus, the knee 63 inhibits the re-lamping assembly 40 from moving downward and the upper portion of the retaining mechanism 60 inhibits upward movement so that the re-lamping cartridge assembly 40 is captured by the retaining mechanisms 62 within the collar 60. The cartridge 40 may be removed by placing a substantial downforce on the cartridge 40 to overcome the spring force 62 and move the cartridge 42 past the knees 63 through the collar 60 and opening in pan 24.

Figure 5:
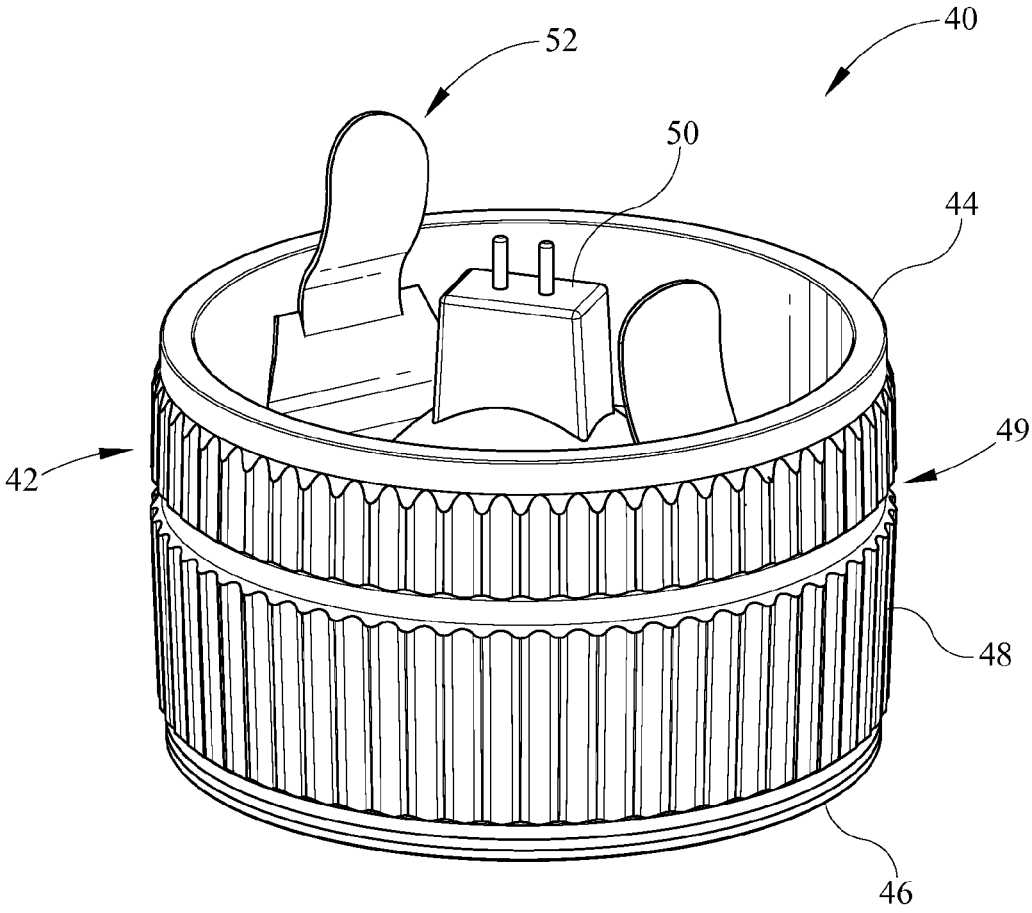
FIG. 5 is a perspective view of a re-lamping cartridge assembly.

Referring now to FIG. 5, a perspective view of the re-lamping cartridge assembly 40 is depicted. The assembly 40 comprises a cartridge 42 having an upper peripheral edge 44 and a lower peripheral edge 46. The cartridge 42 is substantially cylindrical in shape and has a hollow central portion allowing placement of the lamp 50 and a retaining spring 52. Although, the cylindrical shape is depicted, it should be understood that alternative shapes may be utilized. The outer surface of the cartridge 42 may have a knurled finish to aid a person with handling the cartridge assembly 40 during assembly and re-lamping. The cartridge 42 has an outer diameter which is greater than the diameter defined from knee-to-knee 63 around the retaining mechanisms 62. The outer surface 48 further comprises a groove 49 for receiving a knee portion 63 as a retaining mechanism 62. As a result, the springs 62 place a radially inward force on the cartridge 42 as the cartridge 42 moves upwardly through the cartridge support collar 60. At a specific location, the knees 63 are seated in groove 49.

Figure 6:
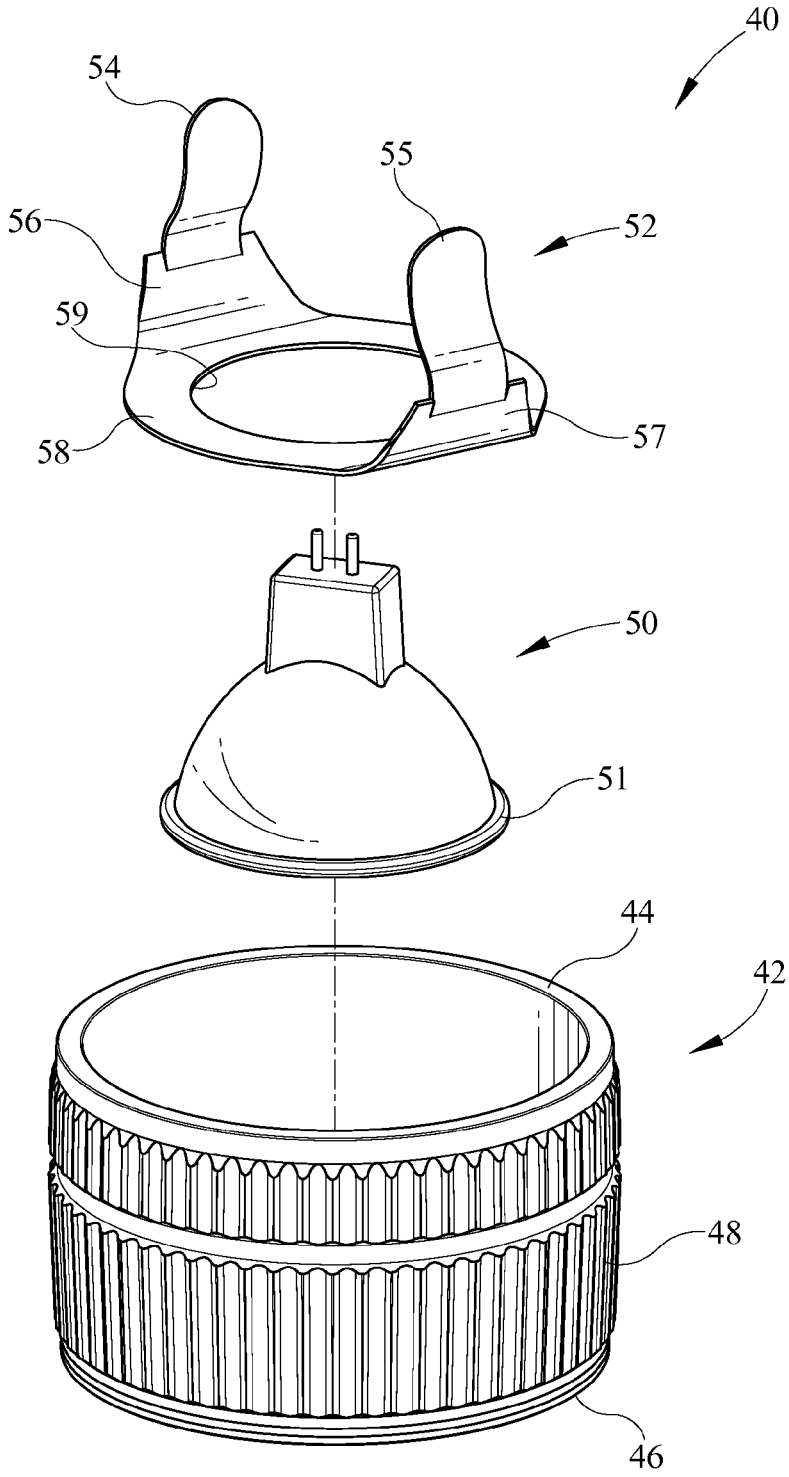
FIG. 6 is an exploded perspective view of the cartridge assembly of FIG. 2.

Referring now to FIG. 6, the cartridge assembly 40 is depicted in exploded 10 perspective view. The cartridge 42 is shown having the upper peripheral edge 44 and lower peripheral edge 46. A knurled surface 48 is located on the outer periphery of the cartridge 42. A lamp 50 is centrally positioned above the aperture of the cartridge 42 for placement within the central portion of the cartridge 42. It should be understood that a small lamp 50 (FIG. 6) or mini lamp of the type generally designated as a MR16 lamp may be mounted in the fixture 10 and may be of the exemplary type described herein. Disposed above the lamp 50 is a spring 52. The spring 52 comprises opposed fingers 54, 55 wherein each finger 54, 55 is connected to an arm 56, 57, respectively. The arms 56, 57 bend upwardly from a body 58 which is generally circular in shape and defines a lamp aperture 59. The lamp 50 is centrally positioned within the cartridge 42. Next, the spring 52 is positioned downwardly over the lamp 50 so that the peripheral edge 51 of the lamp 50 is in contact with the cartridge 42 or against a lens therein. As shown in the exemplary embodiment, the lamp 50 may partially extend through the aperture 59 of spring 52.

Figure 7:
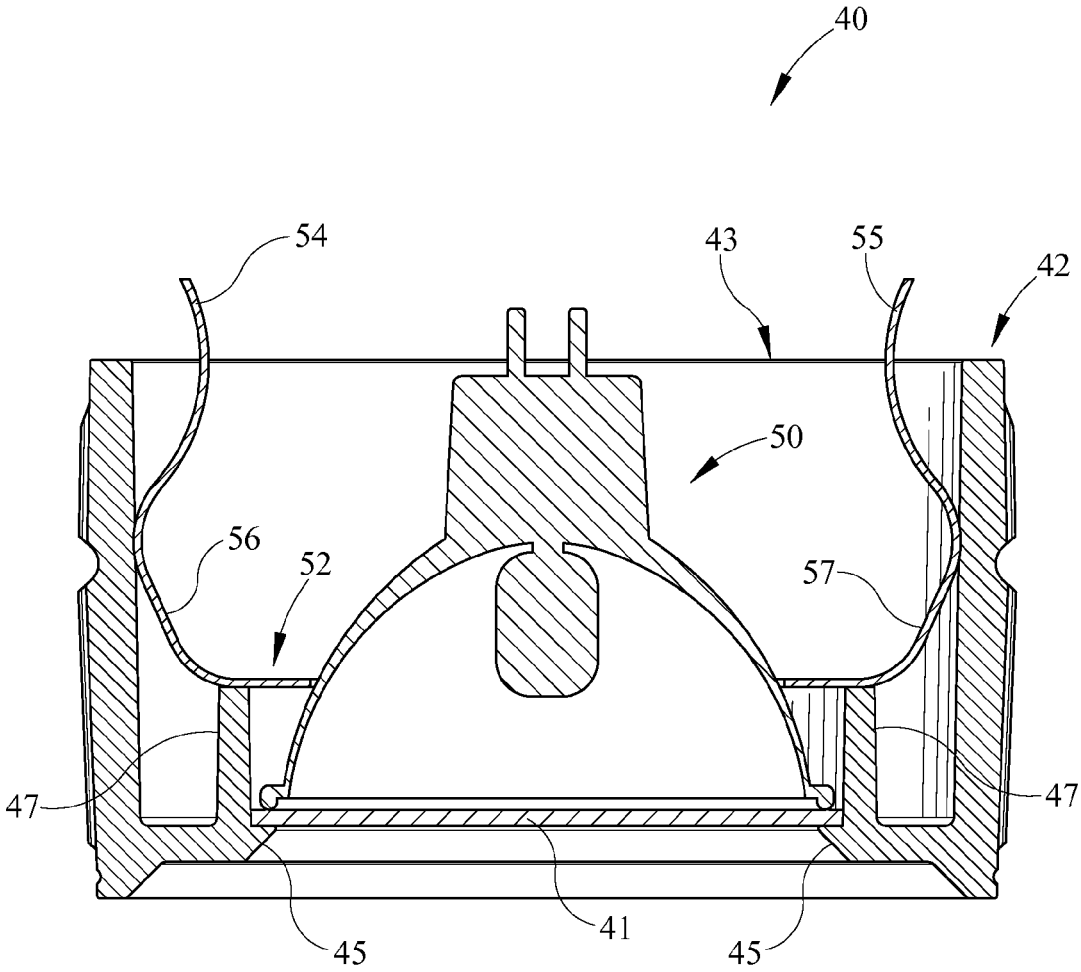
FIG. 7 is a sectional view of the re-lamping cartridge assembly of FIG. 5.

Referring now to FIG. 7, the re-lamping cartridge assembly 40 is shown in a side-sectional view. The cartridge 42 includes sidewalls defining the upper opening 43 and lower opening 45 defined by a lip. Within the lower portion of the cartridge 42 are posts 47 defining a spring seat as well as a lamp positioning area. The lip 45 has a diameter which is equal to or less than the diameter of the peripheral edge 51 of the lamp 50 and provides a seat for the lamp 50, spaced radially inward from the spring seat 47. Alternatively, as indicated, the lip 45 has an inner diameter which is less than the diameter of a lens 41. The lip 45 extending radially inwardly from the spring seat 47 defines a light output opening. As depicted, the spring 52 is positioned against the seat 47 so that the lamp edge 51 (FIG. 6) engages the housing of lamp 50 and retains the lamp 50 seated against the lip defining opening 45 or against the lens seated on the lip defining the opening 45. The arms 56, 57 extend radially outwardly from the body 58 so that the arms 56, 57, fingers 54, 55, or both, engage the sidewall of cartridge 42. Alternatively stated, the inner diameter of cartridge 42 is less than the outermost diameter of the fingers 54, 55, the arms 56, 57, or both. In this position, the fingers 54, 55 extend above the upper peripheral edge 44 of cartridge 42. The fingers 54, 55 have such pre-selected height so as to extend beyond the upper opening 43. Further, the fingers 54, 55 may be engaged with opposed motion squeezing force to disengage the spring 52 from the sidewall of cartridge 42 allowing the spring 52 to be removed from the cartridge 42. Contrariwise, for installation, the lamp 50 is seated against 10 the lip 45 or a lens within the cartridge 42 and the spring 52 is squeezed and inserted into the cartridge 42 against the lamp 50. Thus, the spring 52 captures the lamp 50 within the cartridge 42 inhibiting removal without first engaging and removing the spring 52.

Figure 8:
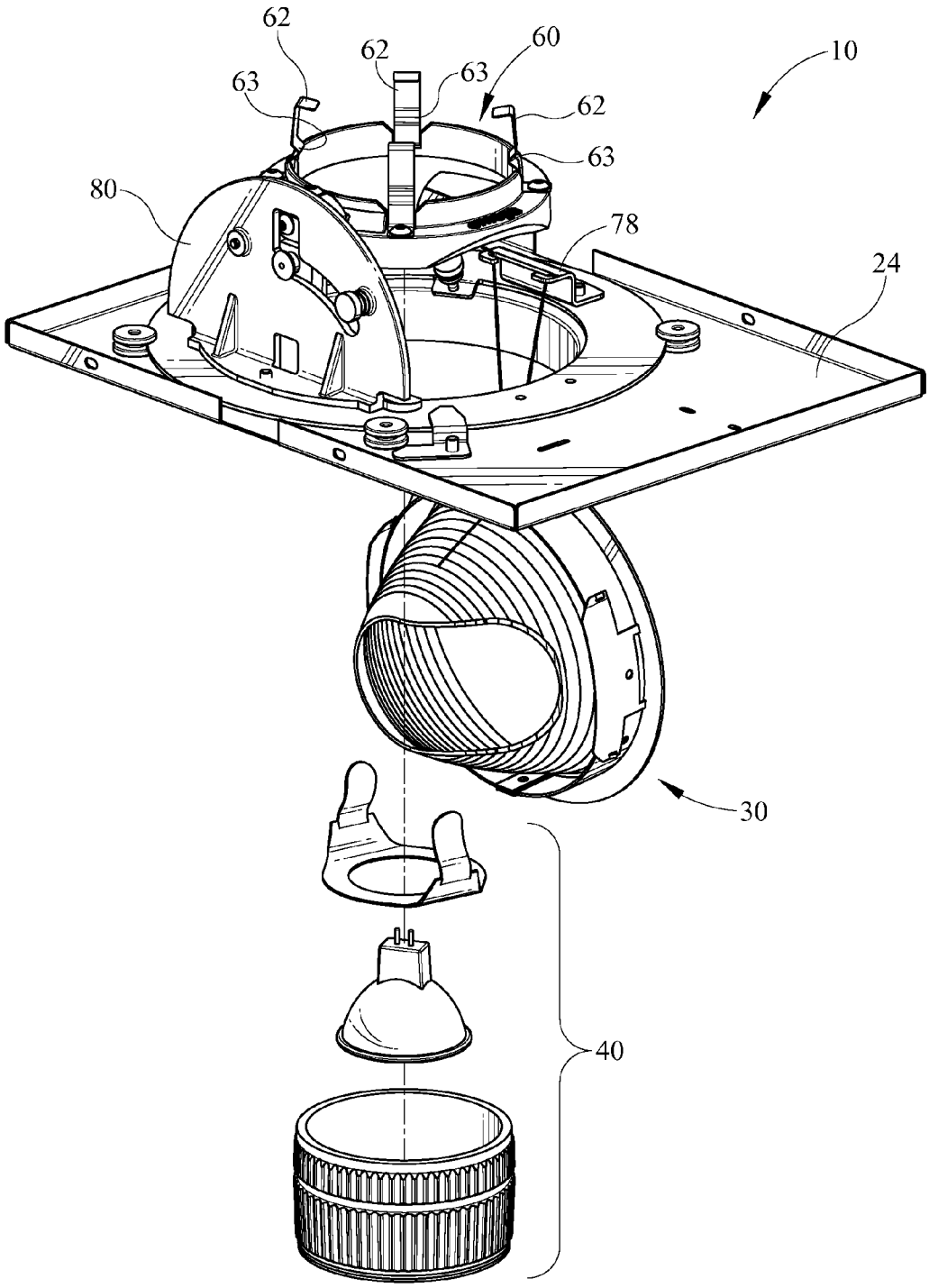
FIG. 8 is a perspective view of the fixture of FIG. 4 with the cartridge of FIG. 5 exploded.

Referring now to FIG. 8, the cartridge assembly 40 is depicted in exploded view beneath the housing pan 24. The reflector trim 30 is pivotally connected to the rotating plate 70 by a spring and the collar 60 is connected to the track plate 84 for pivotal movement relative to the pivot plate 80. The trim 30 is lowered and depending from anchor 78 of the plate 70. With the trim 30 lowered, the cartridge assembly 40 is positioned upwardly through the pan 24 and into the collar 60. The retaining mechanisms 62 extend from the collar 60 in order to receive and return the cartridge 40. Since the diameter of the knees 63 is less than the outer diameter defined by the cartridge 42, the retaining mechanisms 62 frictionally engage the cartridge 42. The cartridge 42 is forced upwardly until the knees 63 are seated within groove 49 and the lamp 50 is facing downward. Accordingly, the upper legs of the retaining mechanisms 62 inhibit further upward motion and the knees 63 inhibit downward motion. In this position, the cartridge assembly 40 is seated within the cartridge support collar 60 for further adjustment of plates 70 and 84 as well as operation.

Figure 9:
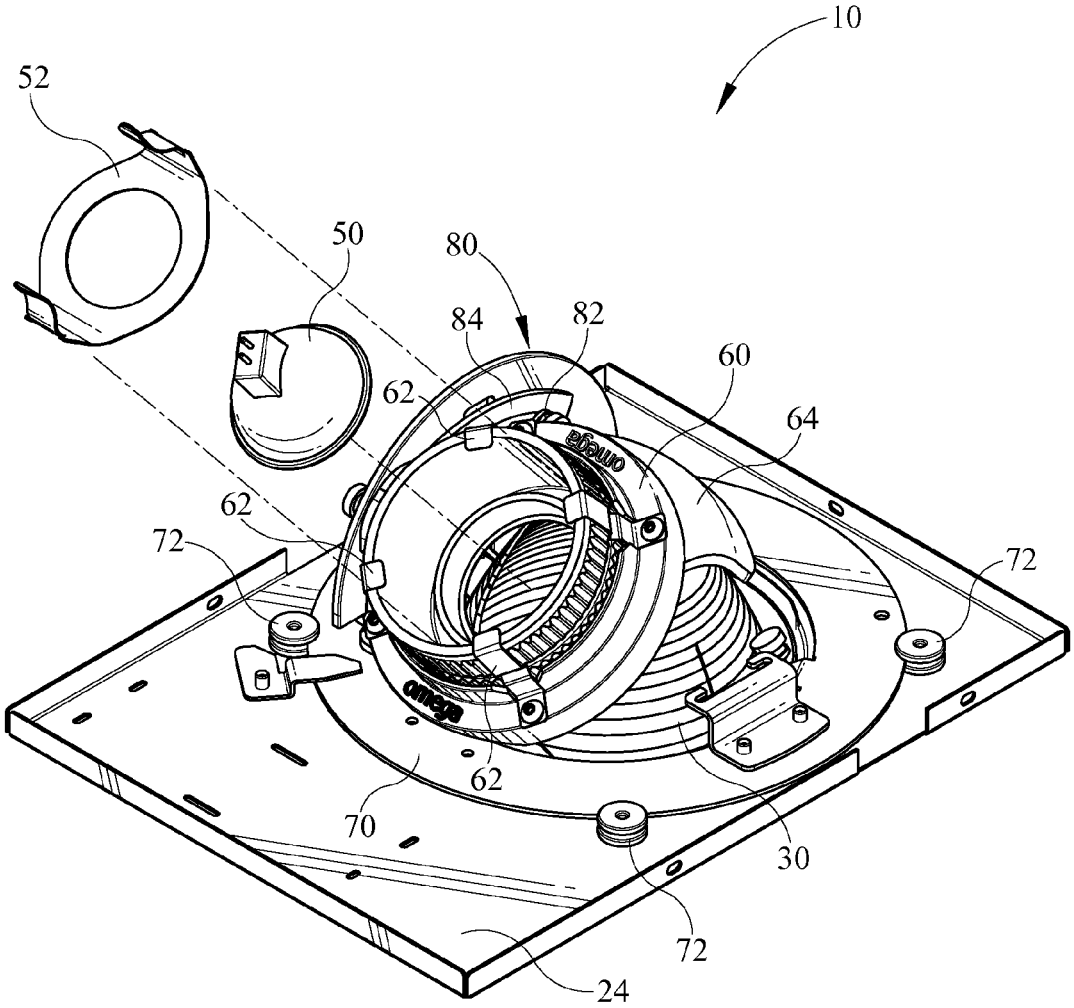
FIG. 9 is an alternative perspective view of the fixture of FIG. 8 pivoted and the cartridge exploded; and, FIG. 10 is a perspective view of the fixture of FIG. 4 in an alternative position.
Figure 10:
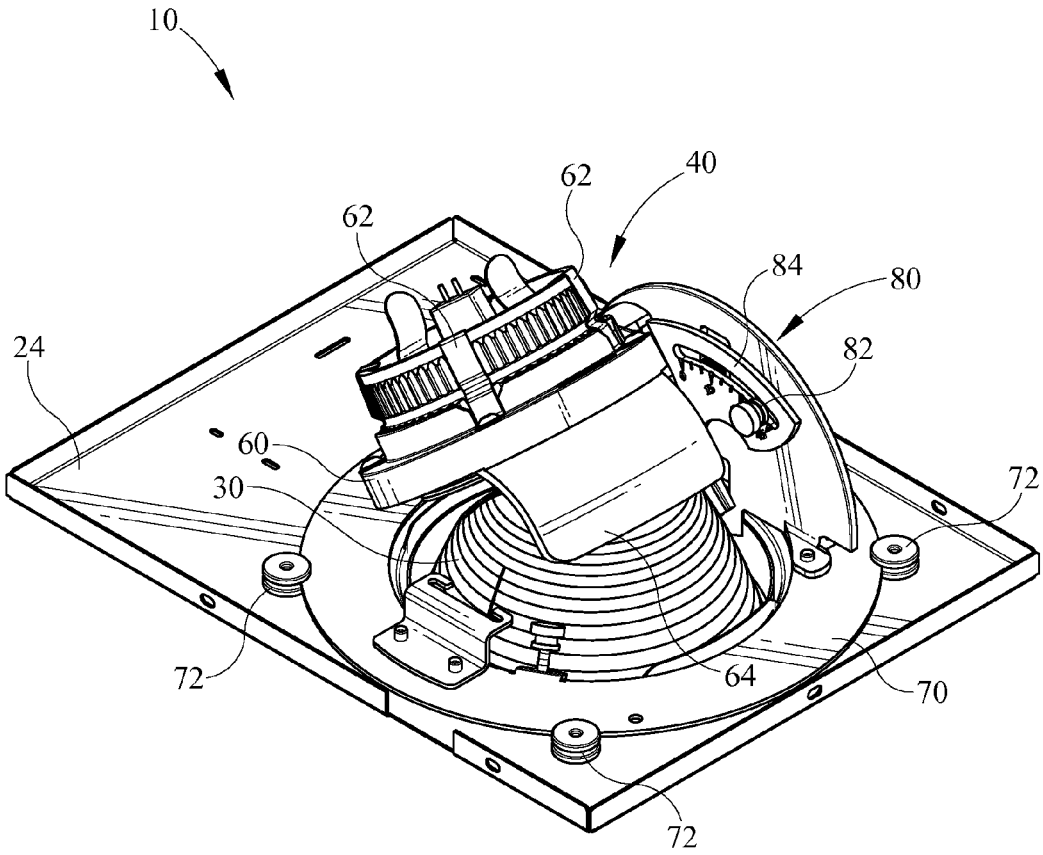

Referring now to FIGS. 9 and 10, the fixture assembly 10 is depicted in two perspective views. The collar 60 and cartridge assembly 40 are shown tilted from the position of FIG. 8. Such tilting or adjustment is performed utilizing the pivot plate 80 and track plate 84. The pivot plate 80 or track plate 84 may move to a desired angle utilizing the graduated marks for measuring the tilt of the cartridge support collar 60 and cartridge assembly 40 relative to the housing pan 24. The rotating plate 70 may also be adjusted to a desirable angular position.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A re-lamping cartridge assembly for a recessed lighting fixture, comprising;

a cartridge having a sidewall defining an upper aperture and a lower aperture;

a lamp positioned within said upper aperture and adjacent said lower aperture; and, a spring positioned within said cartridge to engage said sidewall and capture said lamp within said; and one of a knee or a groove extending along the outer circumference of an exterior of said cartridge for engagement with the other of a knee or a groove of a retaining mechanism retaining said cartridge in said recessed lighting fixture cartridge.

2. The cartridge assembly of claim 1, said cartridge further comprising a retaining feature.

3. The cartridge assembly of claim 1 further comprising a spring seat.

4. The cartridge assembly of claim 1, said cartridge further comprising a lip along an interior of said cartridge, said lamp seated against said lip.

5. The cartridge assembly of claim 4, said spring engaging said lamp and capturing said lamp between said lip and said spring.

6. The cartridge assembly of claim 1, said spring having a first finger extending above an upper peripheral edge of said cartridge.

7. The cartridge assembly of claim 6 further comprising a second finger opposite said first finger, said second finger extending above said upper peripheral edge of said cartridge.

8. The cartridge assembly of claim 1 further comprising a support collar adjustably retaining said cartridge in a recessed fixture housing.

9. A re-lamping cartridge assembly, comprising:

a cartridge having a light output aperture and an upper opening;

a lamp positioned against said light output opening; and, a spring having a lamp aperture, said spring positioned over said lamp wherein said lamp extends through said lamp aperture;

said spring capturing said lamp against said; and one of a knee or a groove extending along the outer circumference of an exterior of said cartridge for engagement with the other of a knee or a groove of a retaining mechanism retaining said cartridge in said recessed lighting fixture cartridge.

10. The cartridge assembly of claim 9 further comprising a lip extending radially inward from a spring seat.

11. The cartridge assembly of claim 10, said lamp seated against said lip.

12. The cartridge assembly of claim 9, said spring seated against said spring seat.

13. The cartridge assembly of claim 9 further comprising a retaining feature on an exterior of said cartridge.

14. The cartridge assembly of claim 9 further comprising a cartridge support collar retaining said cartridge in position within a light fixture.

15. The cartridge assembly of claim 14 further comprising at least one retaining spring extending from said cartridge support collar.

16. The cartridge assembly of claim 15 further comprising a knee extending from said at least one retaining spring for engaging said cartridge.

17. The cartridge assembly for a light fixture, comprising:

a cartridge having a sidewall defining an upper opening and a lower opening; and one of a knee or a groove extending along the outer circumference of an exterior of said cartridge for engagement with the other of a knee or a groove of a retaining mechanism retaining said cartridge in said recessed lighting fixture;

a lamp disposed within said sidewall and adjacent said lower opening;

a spring disposed within said cartridge and engaging said lamp and said sidewall;

a cartridge support collar engaging said cartridge sidewall.

18. The cartridge assembly for a light fixture of claim 17, said cartridge support collar having at least one retaining mechanism.

19. The cartridge assembly for a light fixture of claim 18, said at least one retaining mechanism further comprising a knee.

20. The cartridge assembly for a light fixture of claim 19, said cartridge engaging said knee.

* * * * *